US005102427A

United States Patent [19]

Feldman et al.

[11] Patent Number: 5,102,427

[45] Date of Patent: Apr. 7, 1992

[54] MIDDLE DISTILLATE FUEL HAVING IMPROVED LOW TEMPERATURE FLOW PROPERTIES

[75] Inventors: Nicholas Feldman, Woodbridge; Antonio Gutierrez, Mercerville, both of N.J.

[73] Assignee: Exxon Research & Engineering Company, Florham Park, N.J.

[21] Appl. No.: 652,685

[22] Filed: Feb. 8, 1991

[51] Int. Cl.[5] ..... C10L 1/24; C10L 1/22

[52] U.S. Cl. ..... 44/418; 44/408; 44/424; 44/434; 44/447

[58] Field of Search ..... 44/408, 418, 447, 370, 44/424, 434

[56] References Cited

U.S. PATENT DOCUMENTS

| | | | |
|---|---|---|---|
| 3,444,082 | 5/1969 | Kautsky | 44/406 |
| 3,578,422 | 5/1971 | Dorer, Jr. | 44/370 |
| 3,846,093 | 11/1974 | Feldman | 44/406 |
| 3,999,960 | 12/1976 | Langer, Jr. | 44/447 |
| 4,014,663 | 3/1977 | Feldman et al. | 44/406 |
| 4,164,474 | 8/1979 | Gallacher et al. | 44/370 |
| 4,210,424 | 7/1980 | Feldman et al. | 44/406 |
| 4,211,534 | 7/1980 | Feldman | 44/406 |
| 4,441,890 | 4/1984 | Feldman | 44/370 |
| 4,537,602 | 8/1985 | Rossi et al. | 44/370 |
| 4,755,189 | 7/1988 | Feldman | 44/447 |

*Primary Examiner*—Margaret Medley
*Attorney, Agent, or Firm*—Roy J. Ott

[57] ABSTRACT

The present invention provides for a middle distillate fuel having a boiling range within about 120° to about 400° C. which has enhanced low temperature flow properties. These enhanced properties are provided by the addition of a mixture comprising:

a) the sulfonamide or amine salt reaction product of an alkylaryl sulfonic acid having from about 10 to about 70 carbon atoms and a primary, secondary tertiary or quaternary amine having from 4 to about 40 carbon atoms;

b) an alkyl diphenyl ether wherein the alkyl group contains from about 16 to about 44 carbon atoms; and c) an oil soluble nitrogen-containing compound containing a total of about 30 to about 300 carbon atoms and having at least one straight chain alkyl segment of 8 to 40 carbon atoms and selected from the class consisting of the amine salt and/or amide reaction product of a hydrocarbyl carboxylic acid or anhydride having 1 to 4 carbonyl groups and a primary, secondary, tertiary or quaternary amine having from 4 to about 40 carbon atoms.

This mixture may be added to very low levels to middle distillate oils, i.e., diesel and home heating oil, to yield fuel products having enhanced cold flow properties.

17 Claims, No Drawings

MIDDLE DISTILLATE FUEL HAVING IMPROVED LOW TEMPERATURE FLOW PROPERTIES

BACKGROUND OF THE INVENTION

This invention is related to wax-containing petroleum distillate having improved low temperature flow properties. More specifically, the present invention is related to a wax-containing middle distillate fuel oil having a boiling range within the limits of about 120° and about 400° C.

The problem of improving the cold flow properties of wax-containing distillates has become more pronounced recently because of increases in the demand for certain petroleum products, including kerosene and the middle distillates. Kerosene acts as a solvent for n-paraffin wax, and in former times was a significant component of middle distillate fuel oils. The increased demand for kerosene in jet fuels in more recent times has reduced the amount of kerosene available for use in middle distillate fuel oils. In addition, the increased demand for middle distillate fuel oils, particularly diesel fuel, has made it attractive to maximize the production of middle distillates.

The wax present in middle distillates precipitates at low temperature, forming large waxy crystals which tend to plug the small pore openings of fuel filters. This problem is particularly acute for diesel fuels, where the openings in the fuel filter typically are between about 5.0 and about 50 microns. Conventional pour depressants, which lower the pour point, i.e., the point at which the fuel can no longer be poured, may not be completely satisfactory for preventing pluggage of the fuel filters. While pour depressants often prevent the fuel from setting up as a gel, large wax crystals may be formed. However, to improve the cold flow properties of wax containing middle distillate fuels oils so that the wax does not plug the fuel filter pores, it is necessary that fine wax crystals be formed.

Considerable work has been directed at additives which improve the cold flow properties of the wax-containing middle distillate fuels. U.S. Pat. No. 3,790,359 is directed to the addition of from about 0.1 to about 3 weight percent of an essentially saturated hydrocarbon fraction substantially free of normal paraffinic hydrocarbons and having a number average molecular weight in the range of about 600 to about 3,000, in combination with a copolymer of ethylene and an unsaturated ester, where the copolymer has less than 6 methyl terminating side branches per 100 methylene groups. The weight ratio of the saturated hydrocarbon fraction to the copolymer is disclosed to range between about 25:1 to about 1:1.

U.S. Pat. No. 3,999,960 discloses the use of ethers, particularly alkyldiphenylether, to improve the cold flow properties of wax-containing middle distillate fuels.

U.S Pat. Nos. 3,444,082 and 3,846,093 teach various amides and salts of alkenyl succinc anhydride reacted with amines in combination with an ethylene copolymer as pour point depressants.

In addition, U.S. Pat. No. 4,755,189 discloses a middle distillate fuel having improved low temperature flow properties containing as a pour point depressant, a combination of an amorphous, normally solid, essentially saturated hydrocarbon fraction substantially free of normal paraffin hydrocarbons, a wax modifying random copolymer of ethylene and an unsaturated ester (vinyl acetate) and an alkylated diphenyl ether.

U.S. Pat. No. 4,211,534 discloses a middle distillate fuel additive comprising, as a pour point depressant, a combination of a copolymer of ethylene and an unsaturated ester, a second copolymer containing a polymerized $C_6$ to $C_{30}$ straight chain alkylester of a monoethylenically unsaturated carboxylic acid and an oil soluble nitrogen-containing compound selected from the class of long carbon chain amine salts and/or amides of hydrocarbyl carboxylic acids or anhydrides having 1 to 4 carbonyl groups.

While these and other additive combinations are useful in improving the cold flow properties of middle distillate fuels, frequently they do not reduce wax crystal size to the extent that would enable the waxy fuel to pass through the fuel filters at temperatures that are 5° C. or more below the fuel cloud point.

SUMMARY OF THE INVENTION

The present invention provides for a middle distillate fuel having a boiling range within about 120° to about 400° C. which has enhanced low temperature flow properties. These enhanced properties are provided by the addition of a mixture comprising:

a) the sulfonamide or amine salt reaction product of an alkylaryl sulfonic acid having from about 10 to about 70 carbon atoms and a primary, secondary tertiary or quaternary amine having from 4 to about 40 carbon atoms;

b) an alkyl diphenyl ether wherein the alkyl group contains from about 16 to about 44 carbon atoms; and c) an oil soluble nitrogen-containing compound containing a total of about 30 to about 300 carbon atoms and having at least one straight chain alkyl segment of 8 to 40 carbon atoms and selected from the class consisting of the amine salt and/or amide reaction product of a hydrocarbyl carboxylic acid or anhydride having 1 to 4 carbonyl groups and a primary, secondary, tertiary or quaternary amine having from 4 to about 40 carbon atoms.

This mixture may be added at very low levels to middle distillate oils i.e., diesel and home heating oil, to yield fuel products having enhanced cold flow properties.

DETAILED DESCRIPTION OF THE INVENTION

The sulfonamide or amine salt reaction product (component (a) above) is generally formed by the reaction of equimolar quantities of an alkylaryl sulfonic acid having from about 10 to about 70 carbon atoms and a primary, secondary, tertiary or quaternary amine having from about 4 to about 40 carbon atoms.

The sulfonic acid components of this reaction product can be prepared by several techniques. They may be entirely synthetic or prepared by sulfonation of natural petroleum derived alkyl aromatics. An example of the latter would be the sulfonic acids from sulfuric acid, sulfur trioxide and the like treatment of petroleum fractions. Acids of this type which are particularly useful possess molecular weights within the range of 300 to 650, preferably about 450 to 550. Suitable alkylaromatics for subsequent sulfonation can be synthesized by several techniques. For example, benzene, toluene, naphthalene or phenol can be alkylated with an olefinic fraction or a chlorinated paraffin using a Friedel-Crafts catalyst. The olefins in turn may be produced by oligomerization of ethylene, propylene, higher alpha-olefins or isobutylene using appropriate catalyst systems. Waxy paraffinic fractions can be chlorinated to a suitable level, e.g., one or more Cl atoms per molecule and may be subsequently reacted with an aromatic using $AlCl_3$ as the catalyst. Other methods can also be used. The technique should in no way limit this invention.

Sulfonation may be conducted using any one of several reagents under appropriate conditions. Oleum, concentrated $H_2SO_4$,$SO_3$,$SO_3$— complexes and $ClSO_3H$ are examples. 20% oleum and $SO_3$ are more preferred reagents, and $SO_3$ is most preferred for this application.

Where oleum is the reagent, a 5–15 wt. % excess would be added slowly to the alkylaromatics in a nonreactive hydrocarbon solvent with vigorous mixing and temperature control (about 25–35° C.). The majority of the unreacted sulfuric acid and sludge is then separated using gravity settling after dilution with water. A water or water alcohol wash is then used to remove the last traces of sulfuric acid.

The alkylaromatic can be sulfonated with $SO_3$ swept into the system with a dry carrier gas. Again a nonreactive solvent should be employed to reduce viscosity and facilitate mixing. Alternately, the alkylaromatic can be sulfonated with liquid $SO_3$ dissolved in liquid $SO_2$.

Other suitable techniques are well documented in the literature on organic synthesis (e.g., Kirk-Othmer, Encyclopedia of Chemical Technology, Second Edition Vol. 19, pp. 291–301).

A preferred class of sulfonic acids for use as a reactant in preparing component (a) above consists of monosulfonated alkylated mono- and/or bicyclic aromatic sulfonic acids which are formed by alkylating an aromatic nucleus and thereafter sulfonating the alkylated product. The alkyl group or groups of the alkylated mono and bicyclic aromatic compounds preferably average from about 20 to about 40 total carbons and the group or groups may be straight chain and/or branched in structure. The preferred sulfonic acids for use in the invention are those derived from sulfonation of mono, di-, and trialkyl substituted benzene or naphthalene.

Especially preferred alkyl mono-aryl sulfonic acids are those acids that are formed by alkylating benzene with oligomers of propylene or $C_4$–$C_{10}$ 1-alkenes and thereafter sulfonating the resulting alkylate. Especially preferred acids are those where the alkyl groups are derived from olefin polymers and contain from about 20 to about 40 carbon atoms each, more preferably about 22 to 28 carbon atoms, and an especially preferred compound of this type is a $C_{24}$ benzene sulfonic acid wherein the alkyl radical is derived from a nominal 24 carbon propylene oligomer.

Suitable sulfonic acids and their method of synthesis are described in U.S. Pat. No. 4,441,890, the complete disclosure of which is incorporated herein by reference.

The amino component of the sulfonanide and/or amine salt reaction product may be a primary, secondary, tertiary or even quaternary amine, but preferably is primary or secondary, and generally contains from about 4 to about 40 carbon atoms, more preferably from about 14 to 24 carbon atoms.

Examples of primary amines include n-dodecyl amine, n-tridecyl amine, $C_{13}$ Oxo amine, coco amine, tallow amine, behenyl amine. etc. Examples of secondary amines include methyl-lauryl amine, dodecyl-otcyl amine, coco-methyl amine, tallow-methyl amine, methyl-n-octyl amine, methyl-n-dodecyl amine, methylbehenyl amine, ditallow amine, etc. Examples of tertiary amines include coco-diethyl amine, cyclohexyl-diethyl amine, coco-dimethyl amine, tri-n-octyl amine, dimethyl-dodecyl amine, methyl-ethyl-coco amine, methyl-ethyl n-stearyl amine, etc. Examples of quaternary amino bases or salts include dimethyl dicetyl amino base, dimethyl disteryl amino chloride, etc.

Amine mixtures may also be used and many amines derived from natural materials are mixtures. Thus coco amines derived from coconut oil are a mixture of primary amines with straight chain alkyl groups ranging from $C_8$ to $C_{18}$. Another example is tallow amine, derived from hydrogenated tallow acids, which amine is a mixture of $C_{14}$ to $C_{18}$ straight chain alkyl groups. Tallow amine is particularly preferred.

The amide reaction product may be formed in a conventional manner by heating a mixture of the primary or secondary amine with an approximately stoichiometric quantity of the sulfonic acid component described above in an organic solvent such as toluene, and recovery the reaction product by conventional techniques. The ammonium salts are also conveniently prepared by simply mixing the amine with the acid and stirring, generally with mild heating.

The alkyl diphenyl ether (component (b) above) generally comprises alkylated diphenyl ethers. These ethers may be prepared by alkylating diphenyl ether with dimerized or polymerized alpha olefins as described in U.S. Pat. No. 3,999,960, the complete disclosure of which is incorporated herein by reference. The diphenyl ether preferably is alkylated with the dimer of an alpha olefin having 16 to 44 carbon atoms, more preferably 18 to 28 carbon atoms.

Following is a typical synthesis of the reaction product of diphenyl ether and a $C_{20}$ to $C_{24}$ olefin cut.

EXAMPLE 1

About 136 g of diphenyl ether were charged into a 2 liter 4 necked round bottom flask with 150 ml of chlorobenzene and 10 g of aluminum chloride. While stirring at room temperature under nitrogen atmosphere, 492 g of $C_{20\text{-}24}$ olefin dissolved in 200 ml of chlorobenzene were added at a rate such that the exothermic reaction was kept below 40° C. The reaction mixture was then soaked at 35° C. for one hour. After the one hour soaking period, a solution containing 200 ml 50% NaOH and 100 ml water was slowly added and the mixture was stirred for 10 minutes. The reaction mixture was transferred to a separating funnel and the water layer was removed. The organic layer was washed first with 200 ml of 5% HCl solution and then with 200 ml of a 10% potassium carbonate solution. Finally the organic solution was washed with 200 ml water and dried over magnesium sulfate. The solution was vacuum stripped at about 100° C. to remove the solvent and then stripped at 250° C. for four hours to remove unreacted olefin and mono alkylated products. After 4 hours, the residue was collected. The infrared analysis and GC confirmed the formation of the desired alkylated diphenyl ether product.

The oil soluble nitrogen-containing compound (component (c) above) includes oil soluble amine salts and/or amides which will be generally formed by reaction of at least one molar proportion hydrocarbyl substituted amines with a molar proportion of hydrocarbyl acid having 1 to 4 carboxylic acid groups or anhydrides thereof.

In the case of polycarboxylic acids or anhydrides thereof, all acid groups may be converted to amine salts or amides, or part of the acid groups may be converted to esters by reaction with hydrocarbyl alcohols or part of the acid groups may be left unreacted.

The hydrocarbyl groups of the preceding amine carboxylic acid or anhydride and alcohol compounds include groups which may be straight or branched chain, saturated or unsaturated, aliphatic, cycloaliphatic, aryl, alkaryl, etc. Said hydrocarbyl groups may contain other groups or atoms e.g. hydroxy groups, carbonyl groups, ester groups, or oxygen, sulfur or chlorine atoms. These hydrocarbyl groups will usually be long chain, e.g. $C_{12}$ to $C_{40}$, preferably $C_{14}$ to $C_{24}$. However, some short chains, e.g. $C_1$ to $C_{11}$, may be included as long as the total number of carbons is sufficient for solubility. Thus the resulting compound should contain a sufficient hydrocarbon content so as to be oil soluble and it will therefore normally contain in the range of about 30 to 300, preferably 36 to 160 total carbon atoms. The number of carbon atoms necessary to confer oil solubility will vary with the degree of polarity of the compound. In general, about 36 or more carbon atoms are preferred for each amide linkage present in the compound, while for the more polar amine salts about 72 carbon atoms or more are preferred for each amine salt group. The compound will preferably also have at least one straight chain alkyl segment extending from the compound containing 8 to 40, preferably 12 to 30 carbon atoms. This straight chain alkyl segment may be in one or several of the amino or ammonium ions, or in the acid, or in the alcohol (if an ester group is also present). At least one ammonium salt or amine salt or amide linkage is required to be present in the molecule.

The amines may be primary, secondary, tertiary or quaternary, but preferably are secondary. If amides are to made, then primary or secondary amines will be used. Examples of the carboxylic acids or anhydrides include formic, acetic, hexanoic, lauric, myristic, palmitic, hydroxy stearic, behenic, naphthenic, salicylic, acrylic, linoleic, dilinoleic, trilinoleic, maleic, maleic anhydride, fumaric, succinic, succinic anhydride, alkenyl succinic anhydride, adipic, glutaric, sebacic, lactic, malic, malonic, citraconic, phthalic acids (o,m,or p), e.g. terephthalic, phthalic anhydride, citric, gluconic, tartaric, 9,10-di-hydroxystearic, etc.

The amino component of the nitrogen-containing compound may be generally selected from the same category of amine reactant as set forth above in connection with the synthesis of component (a) and the reaction may also be conducted as set forth above in connection with the synthesis of component (a).

Particularly preferred are nitrogen compounds of the above type that are prepared from dicarboxylic acids, preferably aliphatic dicarboxylic acids. Mixed amine salts/amides are most preferred and these can be prepared by heating phthalic anhydride with a secondary amine, preferably tallow amine at a mild temperature, e.g., 80° C., without the removal of water.

The oil soluble nitrogen-containing compounds are also disclosed in U.S. Pat. No. 4,211,534 as fuel oil additives, the complete disclosure of which is incorporated herein by reference.

The distillate fuel oils to which the components of this invention are added will generally boil within the range of about 120° C. to about 400° C. The fuel oil can comprise atmospheric distillate, vacuum distillate, cracked gas oil or a blend in any proportion of straight run and thermally and/or catalytically cracked distillates. The most common petroleum distillate fuels are kerosene, jet fuels, diesel fuels and heating oils. The heating oil may be a straight atmospheric distillate or it may frequently contain minor amounts, e.g. 0 to 35 wt. %, of vacuum gas oil and/or of cracked gas oils. The low temperature flow problem is most usually encountered with diesel fuels and with heating oils.

The final composition of this invention will generally comprise a major amount of the distillate fuel and from about 0.001 to 0.5 wt. % of each of additive components (a), (b) and (c) described above, with a total additive content of from about 0.003 to about 1.5 wt. %. In general, each of (a), (b) and (c) may comprise from about 10 to about 80 wt. %, the total weight of the (a), (b) and (c) mixture being 100%. In the more preferred embodiment, (a), (b) and (c) are each present in the range of from about 0.008 to about 0.08 wt % and are present each in quantities in the range of from about 25 to 40% by weight, more preferably in equiweight quantities.

Since the cold flow additives of the present invention are each soluble in oils and organic solvents, they may be conveniently provided as concentrates so that they may be easily added to the distillate fuel which is to be treated to improve cold flow properties. Typically a diluent is added so that the additives form a single phase liquid concentrate.

Preferred diluents include the fuel oil itself or a heavy aromatic naphtha. The concentrate is preferably added to the fuel at a temperature substantially above the wax appearance point (cloud point) of the fuel, since the solubility of the additives will be higher at elevated temperature. The concentration of the mixed additives in the concentrate diluent may generally range from about 15 to about 75% by weight additive, move preferably from about 30 to about 55% by weight additive.

Oil soluble as used herein means that the additives are soluble in the fuel at ambient temperatures, e.g., at least to the extent of about 0.1 wt. % additive in the fuel oil at 25° C. However, some of the additive comes out of solution near the cloud point in order to modify the wax crystals that form.

That invention will be further understood by reference to the following Examples which include preferred embodiments of the invention.

EXAMPLE 2

In carrying out this Example, the following additive materials were used:

Additive A

Additive A is prepared by reacting equimolar quantities of a monoalkyl substituted $C_{24}$ benzene sulfonic acid and a secondary tallow hydrogenated amine having a molecular weight of 505, a commercially available product sold by Armak Co., Chemicals Division, Chicago Ill. and designated ARMEEN 2HT. The reaction was conducted by heating a mixture of the reactants in toluene for about 45 minutes followed by recovery of a brownish reaction solid.

Additive B

Additive B is the $C_{20}$–$C_{24}$ alkylated diphenyl ether as prepared in Example 1 set forth above.

Additive C

This additive was prepared in accordance with U.S. Pat. No. 3,982,908 and is the diamide reaction product of phthalic anhydride and the same amine as used in preparing Additive A above (Armeen 2HT). The additive is conveniently prepared by refluxing a mixture of the amine and the anhydride present at about a 2 to 1 respective molar ratio in toluene for about 3 hours at 85° C., followed by recovery of the reaction product.

The additives A, B and C were added individually and in admixture in the amounts shown in Table I to a middle distillate fuel (Rotterdam Diesel Fuel) having a cloud point of −8° C. maintained at a temperature of about 25° C. A test has been devised which has been found to be a relatively accurate indicator of cold flow performance of fuels in passing through filter media. In this test designated as Low Temperature Filterability Test (LTFT), the test fuel is cooled at a rate of 1° C./hour to the desired test temperature and subsequently is passed through a screen having openings 17 microns in diameter under a pressure of 6 inches of mercury. The fuel is determined to pass the test if the fuel flow through the screen is completed in 60 seconds or less.

Results of these tests compared with a control sample containing no additive, samples containing each additive alone, samples containing combinations of two additives and a sample containing the combination of all three additives are reported in Table 1.

TABLE 1

| Weight % Additive Added to −8° C. Cloud Point Rotterdam Diesel Fuel | Lowest Temperature Passing LTFT |
|---|---|
| No Additive | −9° C. |
| 0.05 $C_{24}$ Alkyl Benzene Sulfonic Acid - $C_{18}$ Amine (Additive A) | −12° C. |
| 0.05 Alkyl Diphenyl Ether (Additive B) | −12° C. |
| 0.05 Phthalic Anhydride-Tallow Amine Diamide (Additive C) | −12° C. |
| 0.025 Additive A + 0.025 Additive B | −13° C. |
| 0.025 Additive A + 0.025 Additive C | −13° C. |
| 0.025 Additive B + 0.025 Additive C | −12° C. |
| 0.015 Additive A + 0.015 Additive B + 0.015 Additive C | −22° C. |

As can be seen from the data in Table 1, the combination of the three additives yielded (at a total additive concentration of 0.045%) an LTFT — pass at a temperature at least 9° C. lower than any additive pair at a concentration of 0.05% and at least 10° C. lower than any additive used individually.

What is claimed is:

1. An oil soluble composition for improving the cold flow properties of middle distillate fuels when mixed therewith comprising a mixture of:

a) a sulfonamide or amine salt reaction product of an alkylaryl sulfonic acid having from about 10 to about 70 carbon atoms and a primary, secondary, tertiary or quaternary amine having from about 4 to about 40 carbon atoms;

b) an alkyl diphenyl ether wherein the alkyl group contains from about 16 to about 44 carbon atoms; and c) a nitrogen-containing compound containing a total of about 30 to about 300 carbon atoms and having at least one straight chain alkyl segment of about 8 to about 40 carbon atoms, said nitrogen-containing compound being the amide or amine salt reaction product of a hydrocarbyl carboxylic acid or anhydride having from 1 to 4 carbonyl groups and a primary, secondary, tertiary or quaternary amine having from about 4 to about 40 carbon atoms, each of said components (a), (b) and (c) being present in said mixture at a level within the range of from about 10 to about 80% by weight.

2. The composition of claim 1 wherein said component (a) is the reaction product of monoalkylated benzene sulfonic acid wherein the alkyl group contains 22 to 28 carbon atoms and a secondary alkyl monoamine.

3. The composition of claim 2 wherein said component (a) is the reaction product of a $C_{24}$ alkylated benzene sulfonic acid and a dialkyl secondary amine containing from about 14 to 18 carbon atoms in each alkyl group.

4. The composition of claim 1 wherein said component (b) is prepared by alkylating diphenyl ether with a $C_{20}$ to $C_{24}$ alpha olefin.

5. The composition of claim 1 wherein component (c) is the reaction product of phthalic anhydride and a dialkyl secondary amine containing from about 14 to about 18 carbon atoms in each alkyl group.

6. The composition of claim 1 wherein components (a), (b) and (c) are each present in the mixture at a level within the range of 25 to 40% by weight.

7. The composition of claim 1 comprising a mixture of:

a) the reaction product of a $C_{24}$ alkylated benzene sulfonic acid and a dialkyl secondary amine containing from about 14 to about 18 carbon atoms in each alkyl group;

b) a mono-alkylated diphenyl ether wherein the alkyl group contains 20 to 24 carbon atoms; and c) the reaction product of phthalic anhydride and a dialkyl secondary amine containing from about 14 to about 18 carbon atoms in each alkyl group, wherein each of components (a), (b) and (c) are present in the mixture at a level within the range of 25 to 40% by weight.

8. A concentrate comprising a solution of the oil soluble composition of claim 1, 3, 4, 5, or 7 in an organic diluent at a concentration within the range of from about 15 to about 70% by weight solids.

9. A fuel composition having improved cold flow properties comprising a mixture of a petroleum distillate fuel having a boiling range within the limits of from about 120° C. to about 400° C. and the oil soluble composition of claim 1, said oil soluble composition being present in said fuel at a level within the range of from about 0.003 to about 1.5% by weight.

10. The composition of claim 9 wherein each of said components (a), (b) and (c) are present in said fuel at a level within the range of from about 0.001 to about 0.5% by weight.

11. The composition of claim 10 wherein each of said components (a), (b) and (c) are present in said fuel at a level within the range of from about 0.008 to about 0.08 % by weight.

12. The composition of claim 11 wherein each of said components (a), (b) and (c) are present in said fuel in approximately equiweight proportions.

13. A fuel composition having improved cold flow properties comprising a mixture of a petroleum distillate fuel having a boiling range within the limits of about 120° to about 400° C. and the oil soluble composition of claim 7, said oil soluble composition being present in said fuel at a level within the range of from about 0.003 to about 1.5% by weight.

14. The composition of claim 13 wherein each of said components (a), (b) and (c) are present in said fuel at a level within the range of from about 0.001 to about 0.5% by weight.

15. The composition of claim 14 wherein each of said components (a), (b) and (c) are present in said fuel at a level within the range of from about 0.008 to about 0.08 % by weight.

16. The composition of claim 13 wherein each of said components (a), (b) and (c) are present in said fuel in approximately equiweight proportions.

17. A method for improving the cold flow properties of a petroleum distillate fuel having a boiling range within the limits of from about 120° C. to about 400° C. comprising blending with said fuel the composition of claims 1, 3, 4, 5 or 7 at a concentration within the range of from about 0.003 to about 1.5% by weight.

* * * * *